US011499772B2

(12) United States Patent
Liu et al.

(10) Patent No.: US 11,499,772 B2
(45) Date of Patent: Nov. 15, 2022

(54) DRAWER ASSEMBLY AND REFRIGERATOR

(71) Applicant: BSH Hausgeraete GmbH, Munich (DE)

(72) Inventors: Chunli Liu, Nanjing (CN); Liang Wang, Nanjing (CN); Tao Zhu, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/110,995

(22) Filed: Dec. 3, 2020

(65) Prior Publication Data

US 2021/0180856 A1 Jun. 17, 2021

(30) Foreign Application Priority Data

Dec. 16, 2019 (CN) ..... 201922251812.4

(51) Int. Cl.
*F25D 23/08* (2006.01)
*F25D 25/02* (2006.01)

(52) U.S. Cl.
CPC ..... *F25D 25/025* (2013.01); *F25D 23/087* (2013.01)

(58) Field of Classification Search
CPC ..... F25D 25/025; F25D 23/087
See application file for complete search history.

(56) References Cited

U.S. PATENT DOCUMENTS 2,188,815 A * 1/1940 Murphy ..... F25D 23/087 277/648
2,345,273 A * 3/1944 Macklanburg ..... E06B 7/231 49/444
2,379,193 A * 6/1945 Shields ..... F25D 23/082 49/496.1
3,126,589 A * 3/1964 Monti ..... F25D 23/087 49/482.1
3,323,256 A * 6/1967 Reahard ..... E06B 7/23 49/478.1

(Continued)

FOREIGN PATENT DOCUMENTS

CN 207936610 U 10/2018
JP 2002282192 A 10/2002

(Continued)

*Primary Examiner* — Kimberley S Wright
(74) *Attorney, Agent, or Firm* — Laurence A. Greenberg; Werner H. Stemer; Ralph E. Locher

(57) ABSTRACT

A drawer assembly contains a drawer, a cap, and a sealing member. The drawer has an upward opening. The cap being capable of sliding forward and backward relative to the drawer to open or close the opening. The sealing member is disposed between the cap and the drawer and has a sealing surface between the sealing member and the drawer or the cap, and the sealing surface has a rough feature. More specifically, the sealing surface has the rough feature. Therefore, when the cap closes the opening, a contact area between the sealing member and the drawer or the cap is relatively reduced, binding is relatively weakened, and suction is relatively reduced. The cap can be easily pushed away by merely applying relatively little thrust to open the opening when the opening of the drawer needs to be opened, greatly facilitating use by a user.

10 Claims, 6 Drawing Sheets

(56) References Cited

U.S. PATENT DOCUMENTS

| | | | | | |
|---|---|---|---|---|---|
| 5,248,542 | A * | 9/1993 | Hinzpeter | B30B 11/00 | 100/296 |
| 9,073,670 | B2 * | 7/2015 | Min | F25D 25/025 | |
| 9,140,483 | B2 * | 9/2015 | Park | F25D 17/042 | |
| 9,212,847 | B2 * | 12/2015 | Min | B65D 25/22 | |
| 9,429,354 | B2 * | 8/2016 | Ha | F25D 23/006 | |
| 9,488,405 | B2 * | 11/2016 | Lee | F25D 25/025 | |
| 9,845,984 | B2 * | 12/2017 | Gunduz | F25D 25/025 | |
| 2013/0270986 | A1 * | 10/2013 | Min | F25D 25/025 | 312/330.1 |
| 2014/0300264 | A1 * | 10/2014 | Park | F25D 17/042 | 312/404 |
| 2015/0253065 | A1 * | 9/2015 | Min | F25D 25/028 | 312/404 |
| 2016/0040922 | A1 * | 2/2016 | Ha | F25D 23/02 | 312/404 |
| 2016/0153699 | A1 * | 6/2016 | Lee | F25D 23/025 | 312/404 |
| 2016/0238304 | A1 * | 8/2016 | Gunduz | F25D 25/021 | |
| 2020/0300537 | A1 * | 9/2020 | Park | F25D 23/12 | |
| 2020/0393195 | A1 * | 12/2020 | Wang | F25D 23/067 | |

FOREIGN PATENT DOCUMENTS

| | | | | |
|---|---|---|---|---|
| JP | 2004108752 | A * | 4/2004 | |
| WO | WO-2012052456 | A2 * | 4/2012 | F25D 23/087 |
| WO | 2019105473 | A1 | 6/2019 | |

* cited by examiner

DRAWER ASSEMBLY AND REFRIGERATOR

CROSS-REFERENCE TO RELATED APPLICATION

This application claims the priority, under 35 U.S.C. § 119, of China patent application CN 201922251812.4, filed Dec. 16, 2019; the prior application is herewith incorporated by reference in its entirety.

BACKGROUND OF THE INVENTION

Field of the Invention

The present utility model relates to the field of household appliance technologies, and in particular, to a drawer assembly and a refrigerator.

With continuous improvement of people's living standard and diversified development of food storage requirements, functional requirements of a user for a refrigerator gradually increase. When there are various types of food stored in a refrigerator, flavor tainting easily takes place in the various types of food, consequently affecting use experience of a user. In order to prevent mutual tainting of flavors among the various types of food/items stored in the refrigerator, one way is to dispose sealed drawers in the refrigerator.

BRIEF SUMMARY OF THE INVENTION

The objective of the present utility model is to provide an improved drawer assembly and refrigerator.

The drawer assembly provided in the embodiments of the present utility model includes a drawer, a cap, and a sealing member. The drawer has an upward opening. The cap is capable of sliding forward and backward relative to the drawer to open or close the opening. The sealing member is disposed between the cap and the drawer, and has a sealing surface that seals the drawer or the cap, and the sealing surface is provided with a rough feature.

Optionally, the sealing surface is provided with the rough feature on an entire surface of the sealing surface that is in sealing contact with the drawer or the cap.

Optionally, the sealing surface is provided with the rough feature in a front region and/or a rear region of the sealing surface that is in sealing contact with the drawer or the cap.

Optionally, the rough feature includes a leather feature, a grain feature, or a convex-concave feature.

Optionally, when the cap closes the opening, the sealing member is extruded by the cap and the drawer to expel at least part of air between the sealing member and the drawer or the cap and suck in the drawer or the cap to seal the drawer assembly.

Optionally, the sealing member is mounted to one of the cap and the drawer, and when the cap slides relative to the drawer, a gap exists, in a gravity direction, between the sealing member and the other one of the cap and the drawer.

Optionally, the sealing member is mounted on the cap, and the drawer includes a supporting portion adapted to support the cap; and when the cap closes the opening, the sealing member is pressed on the supporting portion.

Optionally, the drawer assembly further includes a roller, the roller being disposed in one of the cap and the drawer, the other one of the cap and the drawer having a recess, when the cap closes the opening, the roller entering the recess to eliminate the gap, and when the cap slides relative to the drawer to open the opening, the roller sliding out from the recess to form the gap.

Optionally, a top wall of the drawer along a direction of movement of the roller is provided with a limiting portion, and the limiting portion is adapted to restrict movement of the roller in an axial direction of the limiting portion.

The embodiments of the present utility model further provide a refrigerator, including a storage compartment and the foregoing drawer assembly. The drawer assembly is disposed in the storage compartment, and is capable of being pulled out relative to the storage compartment.

Compared with the prior art, the technical solutions of the embodiments of the present utility model have beneficial effects. For example, because the sealing surface of the sealing member is provided with the rough feature, when the cap closes the opening, a contact area between the sealing member and the drawer or the cap is relatively reduced. The opening of the drawer can be opened by merely applying relatively little thrust to the cap, greatly improving use experience of a user.

In another example, in an implementation in which the sealing surface is extruded to deform to form a negative pressure between the sealing surface and the drawer or the cap to improve the sealing effect, because the sealing surface is provided with the rough feature, when an external force is applied to the cap, the negative pressure is easily eliminated, further helping the cap slide relative to the drawer to open the opening.

Other features which are considered as characteristic for the invention are set forth in the appended claims.

Although the invention is illustrated and described herein as embodied in a drawer assembly and a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
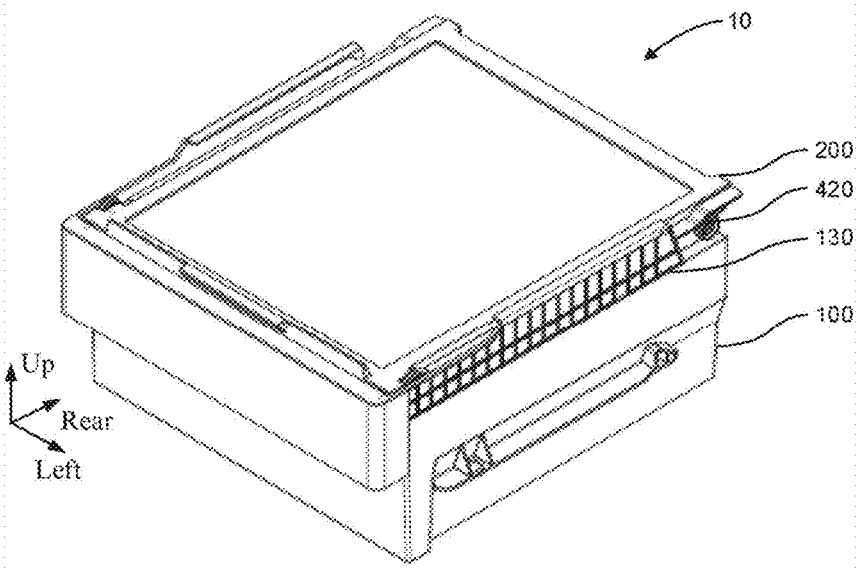
FIG. 1 is a diagrammatic, perspective view of a drawer assembly according to an embodiment of the present utility model.

As described in the background, usually, a sealing member is disposed between a drawer body and a drawer cover in the existing sealed drawer to achieve the sealing effect. A sealing surface of the existing sealing member is usually relatively smooth.

To resolve the foregoing technical problem, the embodiments of the present utility model provide a drawer assembly, including a drawer, a cap, and a sealing member. The drawer has an upward opening. The cap is capable of sliding forward and backward relative to the drawer to open or close the opening. The sealing member is disposed between the cap and the drawer, and has a sealing surface that seals the drawer or the cap, and the sealing surface is provided with a rough feature.

Compared with the prior art in which the sealing surface of the sealing member is relatively smooth, the sealing surface of the sealing member provided in the embodiments of the present utility model is provided with the rough feature. Therefore, when the cap closes the opening, a contact area between the sealing member and the drawer or the cap is relatively reduced; and the cap can be easily pushed away by merely applying relatively little thrust to open the opening when the opening of the drawer needs to be opened, greatly facilitating use by a user and improving use experience of the user.

To make the objectives, features, and beneficial effects of the embodiments of the present utility model more comprehensible, the following describes the specific embodiments of the present utility model in detail with reference to the accompanying drawings.

In order to facilitate description of the drawer assembly provided in the embodiments of the present utility model, some of the accompanying draws provided in the embodiments of the present utility model show six directions that are up, down, left, right, front, and rear. The six directions are determined from a perspective of the drawer assembly facing a user in a normal use state. The "front" represents a direction in which the drawer assembly draws near the user, the "rear" represents a direction in which drawer assembly is away from the user, "left" and "right" are determined according to a natural orientation division based on the foregoing "front" and "rear" directions, the "up" represents a direction in which the cap of the drawer assembly is located, and "down" represents a direction in which the drawer of the drawer assembly is located. Referring to the foregoing directions, in technical solutions provided in the embodiments of the present utility model, the cap slides backward relative to the drawer to open the opening, and the cap slides forward relative to the drawer to close the opening. It should be understood that, from another perspective of the drawer assembly, there are also corresponding directions up, down, left, right, front, and rear corresponding to the perspective. The directions up, down, left, right, front, and rear shown in some of the accompanying drawings provided in the embodiments of the present utility model are merely used for helping describe the technical solutions provided in the embodiments of the present utility model, but do not limit description of the solutions.

Figure 2:
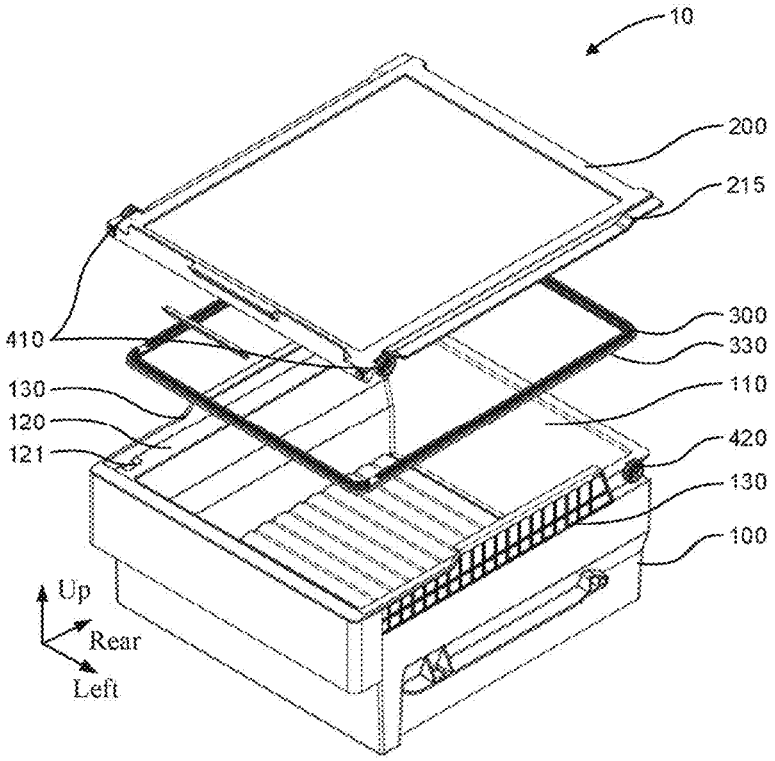
FIG. 2 is an exploded, perspective view of the drawer assembly according to an embodiment of the present utility model.

Referring now to the figures of the drawings in detail and first, particularly to FIG. 1 thereof, there is shown a schematic diagram of a drawer assembly according to an embodiment of the present utility model; and FIG. 2 is an exploded diagram of the drawer assembly according to an embodiment of the present utility model.

As shown in FIG. 1 and FIG. 2, a drawer assembly 10, including a drawer 100, a cap 200, and a sealing member 300 is provided in the embodiments of the present utility model. The drawer 100 has an upward opening 110; the cap 200 is capable of sliding forward and backward relative to the drawer 100 to open or close the opening 110; and the sealing member 300 is disposed between the cap 200 and the drawer 100, and has a sealing surface 330 that seals the drawer 100 or the cap 200. The sealing surface 330 is provided with a rough feature.

Figure 3:
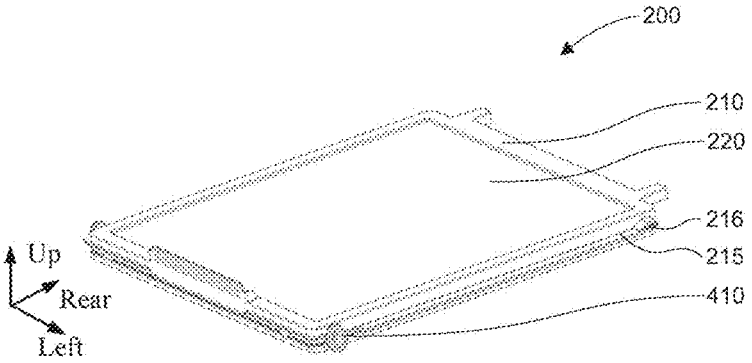
FIG. 3 is a perspective view of a cap according to an embodiment of the present utility model.

FIG. 3 is a schematic diagram of a cap according to an embodiment of the present utility model.

As shown in FIG. 3, in an embodiment, the cap 200 may include a cap frame 210 and a cap lid 220 disposed in the cap frame 210.

The cap frame 210 may be made of a material such as plastic, silica gel, or the like. The cap lid 220 may be made of a tempered glass panel. The tempered glass panel may, on one hand, strengthen a gravity of the cap 200 applied to the sealing member 300 to extrude the sealing member 300 to seal the drawer assembly 10, and on the other hand, make it possible that a user can observe the inside of the drawer 100 through the cap lid 220 because of the transparency of the tempered glass panel.

In some other embodiments, the cap lid 220 may alternatively be made of other materials with sufficient weight. For example, the material may be a ceramic plate, a ceramic plate embedded with tempered glass, or the like.

In the technical solutions provided in the embodiments of the present utility model, the sealing member 300 may be mounted to one of the cap 200 and the drawer 100.

In a preferred embodiment, the sealing member 300 may be mounted on one side of the cap 200 facing toward the drawer 100. When the cap 200 closes the opening 110, the sealing member 300 can be pressed along with the cap 200 onto the drawer 100 and be extruded to seal the drawer assembly 10. Compared with a case that the sealing member 300 is mounted on the drawer 100, mounting the sealing member 300 on the cap 200 is more advantageous to the hiding of the sealing member 300, to effectively reduce the possibility that the sealing member 300 is contaminated.

Figure 4:
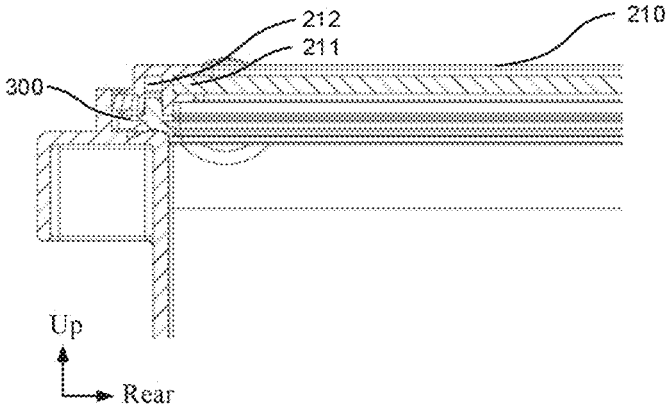
FIG. 4 is a cross-sectional view of the drawer assembly along a front-rear direction thereof according to an embodiment of the present utility model.

FIG. 4 is a cross-sectional view of a drawer assembly along a front-rear direction thereof according to an embodiment of the present utility model.

As shown in FIG. 4, in an embodiment, the cap frame 210 may be provided with a first slot 211 and a second slot 212 that are isolated from each other.

The first slot 211 may be disposed inside of the cap frame 210 and open towards the cap lid 220 to be adapted to receive the cap lid 220. The cap lid 220 may be inserted into the first slot 211 through an edge of the cap lid 220 to be mounted in the cap frame 210.

The second slot 212 may be disposed at the bottom of the cap frame 210 and open towards the sealing member 300 to be adapted to receive the sealing member 300. The sealing member 300 may be inserted into the second slot 212 through the top of the sealing member 300 to be mounted on one side of the cap frame 210 facing toward the drawer 100.

In a preferred embodiment, the second slot 212 may be located on the outside of the first slot 211 to ensure that there is no mutual effect between the first slot 211 and the second slot 212. The outside is a side of the cap frame 210 that is away from the cap lid 220 in a horizontal direction.

In a preferred embodiment, the first slot 211 may be disposed along the whole inside circle of the cap frame 210 to be adapted to a case that the cap lid 220 is tightly mounted. The inside is a side of the cap frame 210 that is near the cap lid 220 in a horizontal direction.

In a preferred embodiment, the sealing member 300 may be a closed sealing ring, and the second slot 212 may be disposed along the whole bottom circle of the cap frame 210 to be adapted to a case that the sealing ring is tightly mounted.

Figure 5:
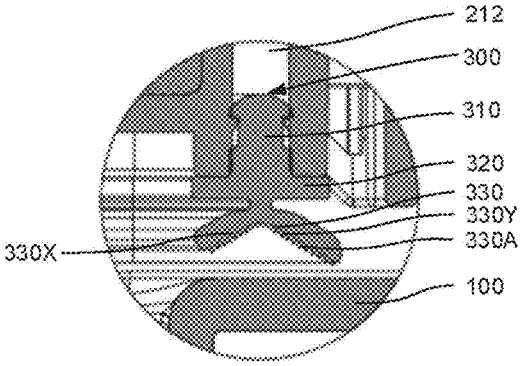
FIG. 5 is a schematic partial diagram of the drawer assembly in an unsealed state according to an embodiment of the present utility model.

FIG. 5 is a schematic partial diagram of a drawer assembly in an unsealed state according to an embodiment of the present utility model.

As shown in FIG. 5, in a preferred embodiment, the sealing surface 330 may include a first sealing surface 330X and a second sealing surface 330Y that are intersected. When the sealing member 300 is extruded, the first sealing surface 330X and the second sealing surface 330Y are flattened to achieve a better sealing effect between the sealing member 300 and the drawer 100.

The cross section of the sealing member 300 may be in a shape of a Chinese character "大". The upper part 310 of the cross section "大" is formed as a fixing portion of the sealing member 300, and is adapted to be inserted into the second slot 212 to be tightly mounted on the cap frame 210. The width of the traverse part 320 on the cross section "大" of the sealing member 300 is greater than that of the upper part 310. The traverse part 320 of the cross section "大" is tightly attached to the bottom of the cap frame 210 and defines the depth of insertion of the upper part 310 in the second slot 212. The bottom of the lower part of the cross section "大" is adapted to be used as the sealing surface 330 of the sealing member 300.

Figure 6:
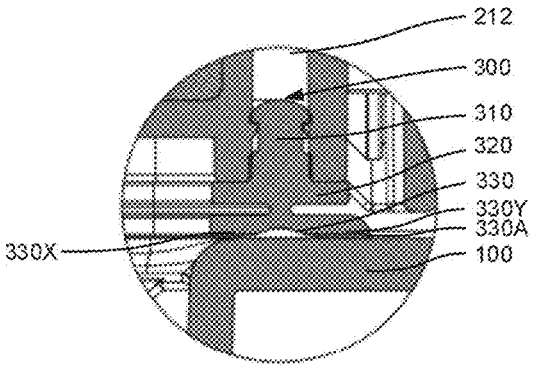
FIG. 6 is a schematic partial diagram of the drawer assembly in a sealed state according to an embodiment of the present utility model.

FIG. 6 is a schematic partial diagram of a drawer assembly in a sealed state according to an embodiment of the present utility model.

As shown in FIG. 6, the sealing member 300, especially the lower part of the sealing surface 330 of the sealing member 300 is elastic and compressible to deform. Therefore, when the cap 200 closes the opening 110, the sealing member 300 may be extruded by the cap 200 and the drawer 100 to expel at least part of air between the sealing surface 330 and the drawer 100 and suck in the drawer 100 through the sealing surface 330 to seal the drawer assembly 10.

Specifically, when the cap 200 closes the opening 110, the lower part of the sealing member 300 presses against the upper edge of the drawer 100 through the sealing surface 330, and is extruded to deform, at the same time, at least part of air between the sealing surface 330 and the upper edge of the drawer 100 is expelled, so that the sealing surface 330 can suck in the upper edge of the drawer 100 and seal the drawer assembly 10.

Further, the sealing member 300 may be provided with an air exhaust hole with two run-through ends. One end of the air exhaust hole communicates with external air, and the other end communicates with the sealing surface 330 of the sealing member 300. The air exhaust hole is adapted to timely expel the at least part of air between the sealing surface 330 and the drawer 100 when the cap 200 closes the opening 110.

Further referring to FIG. 5, in the technical solutions provided in the embodiments of the present utility model, the sealing surface 330 of the sealing member 300 is provided with a rough feature 330A. Therefore, when the cap 200 closes the opening 110, a contact area between the sealing surface 330 of the sealing member 300 and the drawer 100 is relatively reduced; and the cap 200 can be easily pushed away by merely applying relatively little thrust when the opening 110 of the drawer 100 needs to be opened.

In addition, when the sealing member 300 is mounted on the drawer 100, the rough feature 330A is disposed on the sealing surface of the sealing member 300 facing toward the cap 200. When the cap 200 closes the opening 110, a contact area between the sealing surface of the sealing member 300 and the cap 200 is relatively reduced; and similarly the cap 200 can be easily pushed away by merely applying relatively little thrust when the opening 110 of the drawer 100 needs to be opened.

Compared with a case in the prior art that a sealing surface of a sealing member is relatively smooth, suction between the sealing surface and a drawer or a cap is relatively large, and it is difficult to open the drawer, the technical solutions provided in the embodiments of the present utility model can make a user open the opening 110 of the drawer 100 more easily, greatly facilitating use by the user and improving use experience of the user.

In an embodiment, the sealing surface 330 of the sealing member 300 may be provided with the rough feature 330A along a whole circle of a surface of the sealing surface 330 that is in sealing contact with the drawer 100 or the cap 200.

Figure 7:
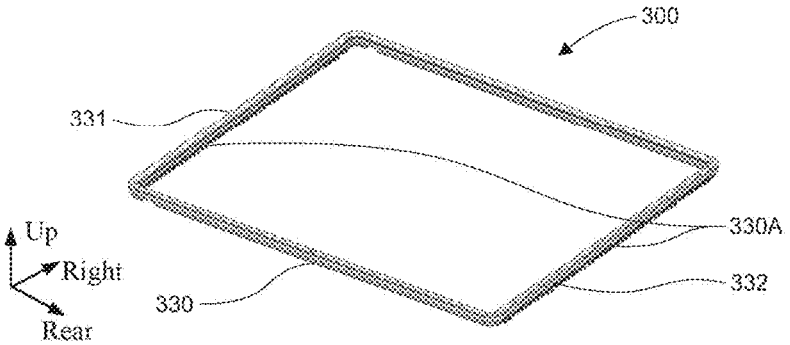
FIG. 7 is a perspective view of a sealing member according to an embodiment of the present utility model.

FIG. 7 is a schematic diagram of a sealing member according to an embodiment of the present utility model.

As shown in FIG. 7, in some other embodiments, the sealing surface 330 of the sealing member 300 may be provided with the rough feature 330A in a front region 331 and/or a rear region 332 of the sealing surface 330, especially provided with the rough feature 330A in both the front region 331 and the rear region 332.

That the sealing member 300 is mounted on the cap 200 is used as an example for description. As compared with other regions of the sealing surface 330, when the cap 200 needs to slide backward relative to the drawer 100 to open the opening 110, larger thrust needs to be applied to the front region 331 and the rear region 332 of the sealing surface 330.

Therefore, the front region 331 and the rear region 332 of the sealing surface 330 being provided with the rough feature 330A can help reduce the foregoing thrust.

In addition, as compared with a case that the whole circle of the sealing surface 330 is provided with the rough feature 330A, in the technical solution provided in the foregoing embodiment, by merely disposing a smaller quantity of rough features 330A on a partial region of the sealing surface 330, the cap 200 can be easily pushed away to open the opening 110 of the drawer 100.

In the technical solutions provided in the embodiments of the present utility model, the rough feature 330A may include a leather feature, a grain feature, a convex-concave feature, or the like. The grain feature may be a milled sand feature.

It should be noted that, the surface roughness of the sealing surface 330 that is provided with the rough feature 330A should not be excessively large, to avoid a case that the sealing surface 330 cannot effectively suck in the drawer 100 and cannot effectively seal the drawer assembly 10 when the cap 200 closes the opening 110.

The specific surface roughness of the sealing surface 330 may be specifically determined according to attributes of the sealing surface 330 and the drawer 100, user experience about thrust required to open the drawer 100, and the like.

In addition, as compared with the case that the sealing member 300 is mounted on the drawer 100, specific surface roughness of a corresponding sealing surface needs to be specifically determined according to attributes of the sealing surface 330 and the cap 200, user experience about thrust required to open the drawer 200, and the like.

The specific method for determining the surface roughness and the method for setting different levels of surface roughness on the sealing surface 330 of the sealing member 300 according to requirements are both common technologies in this technical field, which, therefore, are not repeated in the technical solutions provided in the embodiments of the present utility model.

Further, in the technical solutions provided in the embodiments of the present utility model, the sealing member 300 may be mounted to one of the cap 200 and the drawer 100. When the cap 200 slides relative to the drawer 100, a gap may exist, in a gravity direction, between the sealing member 300 and the other one of the cap 200 and the drawer 100.

The existence of the gap not only helps the cap 200 slide relative to the drawer 100 to successfully open the opening 110, but also prevents the rough feature of the sealing surface 330 from being reduced or worn.

Figure 8:
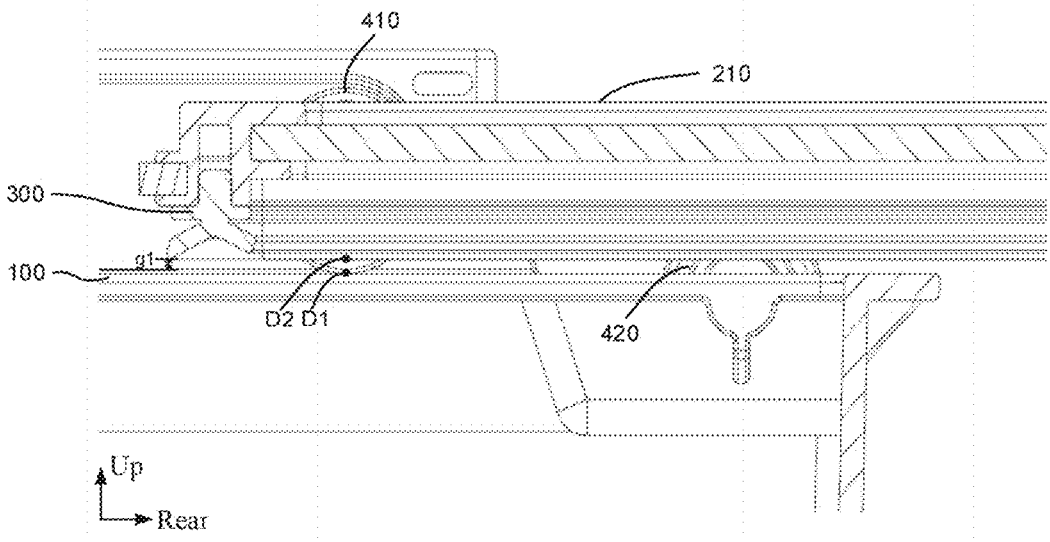
FIG. 8 is a cross-sectional view of the drawer assembly along a front-rear direction thereof according to an embodiment of the present utility model.

FIG. 8 is another cross-sectional view of a drawer assembly along a front-rear direction thereof according to an embodiment of the present utility model.

As shown in FIG. 8, in an embodiment, the sealing member 300 is mounted on one side of the cap 200 facing toward the drawer 100. When the cap 200 slides relative to the drawer 100 to open the opening 110, a gap g1 exists, in a gravity direction, between the sealing member 300 and the drawer 100.

The existence of the gap g1 can reduce and even avoid sliding contact between the sealing surface 330 of the sealing member 300 and the drawer 100, to avoid sliding friction between the sealing surface 330 of the sealing member 300 and the drawer 100. The method not only helps the cap 200 slide relative to the drawer 100 to successfully open the opening 110, but also prevents the rough feature of the sealing surface 330 from being reduced or worn.

Further referring to FIG. 2 and FIG. 8, the drawer 100 may further include a supporting portion 120 adapted to support the cap 200. When the cap 200 slides relative to the drawer 100, the gap g1 may exist, in a gravity direction, between the sealing member 300 and the supporting portion 120; and when then cap 200 closes the opening, the sealing member 300 is pressed onto the supporting portion 120.

Further, in the technical solutions provided in the embodiments of the present utility model, the drawer assembly 10 may further include rollers. The rollers may be disposed on one of the cap 200 and the drawer 100. The other one of the cap 200 and the drawer 100 has a recess.

When the cap 200 closes the opening 110, the roller enters the recess to eliminate the gap g1, and when the cap 200 slides relative to the drawer 100 to open the opening 110, the roller slides out from the recess to form the gap g1.

Referring to FIG. 1 and FIG. 2. There may be two groups of rollers. One group is disposed on the left side of the drawer 100, and the other group is disposed on the right side of the drawer 100. Each group includes two rollers, one being a front roller 410 disposed near the front part of the drawer 100, the other being a rear roller 420 disposed near the rear part of the drawer 100.

In an embodiment, the front roller 410 may be mounted on the cap 200, and the rear roller 420 may be mounted on the drawer 100, as shown in FIG. 2.

Figure 9:
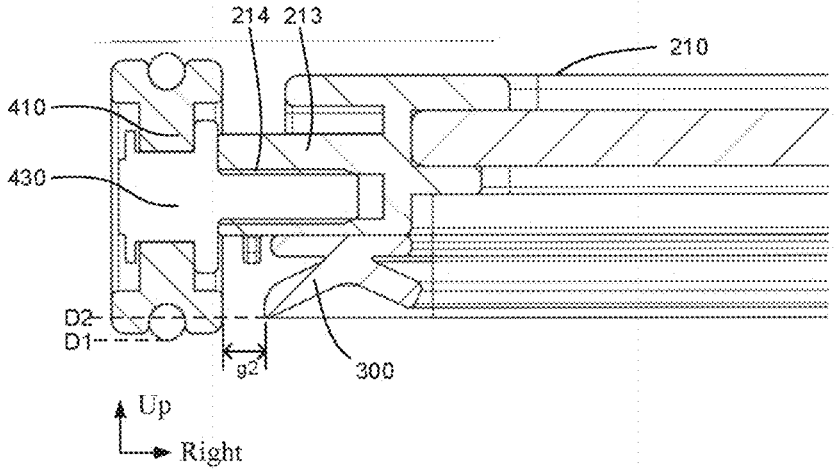
FIG. 9 is a cross-sectional view of the drawer assembly along a left-right direction thereof according to an embodiment of the present utility model.

FIG. 9 is a cross-sectional view of a drawer assembly along a left-right direction thereof according to an embodiment of the present utility model.

A manner of mounting the front roller 410 on the cap 200 is described in the following with reference to FIG. 9. As shown in FIG. 9, a mounting portion 213 that extends along a horizontal direction to the left side of the cap frame 210 is disposed on the lower left side of the cap frame 210. The mounting portion 213 is provided with a third slot 214 that faces toward the outside of the cap frame 210 and is isolated from the second slot 212. A roller rotating shaft 430 is mounted in the third slot 214. One end of the roller rotating shaft 430 may be secured to the third slot 214 through a threaded connection, and the other end is in rotating connection to the rotating center of the front roller 410.

Further referring to FIG. 9, there is a gap g2 in an axial direction of the front roller 410 between the front roller 410 and the sealing member 300. The gap g2 can not only ensure that rolling of the front roller 410 is not affected by the sealing member 300, but also avoid abrasion of the sealing member 300 caused by rolling of the front roller 410.

FIG. 9 merely shows an implementation of the front roller 410 mounted on the left side of the cap 200. For the front roller 410 mounted on the right side of the cap 200, the implementation thereof is similar to FIG. 9, and is not repeated.

Further, corresponding to a position of the front roller 410, a front recess 121 that faces toward the front roller 410 may be disposed on the supporting portion 120 of the drawer 100, as shown in FIG. 2. When the cap 200 closes the opening 110, the front roller 410 entering the front recess 121 to eliminate the gap g1, and when the cap 200 slides relative to the drawer 100 to open the opening 110, the front roller 410 slides out from the front recess 121 to form the gap g1.

After the front roller 410 slides out from the front recess 121, the front roller 410 may slide backward relative to the drawer 100 on the supporting portion 120. The speed of rolling back by the front roller 410 is the same as the speed at which the cap 200 slides backward.

Further referring to FIG. 8 and FIG. 9, in the technical solutions provided in the embodiments of the present utility model, the lowest point D1 of the front roller 410 can be lower than the lowest point D2 of the sealing member 300 in a free state, to ensure that there is a gap g1 between the sealing member 300 and the upper edge of the drawer 100 when the cap 200 moves relative to the drawer 100 with the support of the front roller 410. The free state is a state in which the sealing member 300 is not extruded by the cap 200 because of the gravity of the cap 200.

Further, a top wall of the drawer 100 along a direction of movement of the front roller 410 is provided with a limiting portion 130, as shown in FIG. 2. The limiting portion 130 is adapted to restrict movement of the front roller 410 in an axial direction of the limiting portion, to prevent the front roller 410 from sliding beyond the supporting portion 120 in a rolling process.

In the technical solutions provided in the embodiments of the present utility model, the rear roller 420 may also be mounted on the left and right sides of the drawer 100 through a roller rotating shaft. The mounting principle of the rear roller 420 is the same as the mounting principle of the front roller 410.

Correspondingly, as shown in FIG. 2 and FIG. 3, corresponding to a position of the rear roller 420, the cap frame 210 is further provided with an adaption 215. The adaption 215 is provided with a rear recess 216 open toward the corresponding rear roller 420, as shown in FIG. 3.

When the cap 200 closes the opening 110, the rear roller 420 enters the rear recess 216 to eliminate the gap g1, and when the cap 200 slides relative to the drawer 100 to open the opening 110, the rear roller 420 slides out from the rear recess 216 to form the gap g1.

The embodiments of the present utility model further provide a refrigerator, including a storage compartment and the foregoing drawer assembly 10; the drawer assembly 10 being disposed in the storage compartment, and being capable of being pulled out relative to the storage compartment.

It should be noted that, the drawer assembly 10 provided in the embodiments of the present utility model may further be applied to other refrigerating devices that need to store items in an isolated and sealing manner such as a refrigerated cabinet and a freezer.

Although specific implementations have been described above, the implementations are not intended to limit the scope of the present invention, even if only one implementation is described with respect to specific features. The feature examples provided in the present invention are intended to be illustrative rather than limiting, unless otherwise stated. In a specific implementation, technical features of one or more dependent claim and technical features of independent claims are combined according to actual requirements and in a feasible technology. Technical features from corresponding independent claims may be combined by any proper manner rather than only by a specific combination exemplified in the claims.

Although the present utility model is disclosed above, the present utility model is not limited thereto. Any person skilled in the art may make variations and modifications without departing from the spirit and scope of the present utility model. Therefore, the protection scope of the present utility model should be subject to the claims.

The invention claimed is:

1. A drawer assembly, comprising:

a drawer having an upward opening formed therein;

a cap being capable of sliding forward and backward relative to said drawer to open or close said opening; and a sealing member disposed between said cap and said drawer, said sealing member having a sealing surface sealing against said drawer or said cap, said sealing surface having a rough feature disposed over a cross sectional extent of said sealing surface engaging against said drawer or said cap in a closed position of said drawer, said sealing member having a cross section in the shape of a Chinese character 大, and a bottom of the lower part of the Chinese character 大 being configured as said sealing surface.

2. The drawer assembly according to claim 1, wherein said sealing surface is provided with said rough feature on an entire surface of said sealing surface that is in sealing contact with said drawer or said cap.

3. The drawer assembly according to claim 1, wherein said sealing surface is provided with said rough feature in a front region and/or a rear region of said sealing surface that is in sealing contact with said drawer or said cap.

4. A drawer assembly, comprising:

a drawer having an upward opening formed therein;

a cap being capable of sliding forward and backward relative to said drawer to open or close said opening; and a sealing member disposed between said cap and said drawer, said sealing member having a sealing surface sealing said drawer or said cap, said sealing surface having a rough feature, said rough feature containing a leather feature, a grain feature, or a convex-concave feature, said sealing member having a cross section in the shape of a Chinese character 大, and a bottom of the lower part of the cross section 大 being configured as said sealing surface.

5. The drawer assembly according to claim 1, wherein when said cap closes said opening, said sealing member is extruded by said cap and said drawer to expel at least part of any air between said sealing member and said drawer or said cap and suck in said drawer or said cap to seal the drawer assembly.

6. The drawer assembly according to claim 1, wherein said sealing member is mounted to one of said cap and said drawer, and when said cap slides relative to said drawer, a gap exists, in a gravity direction, between said sealing member and the other one of said cap and said drawer.

7. The drawer assembly according to claim 6, wherein:

said sealing member is mounted on said cap; and said drawer has a supporting portion adapted to support said cap, and when said cap closes said opening, said sealing member is pressed on said supporting portion.

8. The drawer assembly according to claim 6, further comprising a roller, said roller disposed in one of said cap and said drawer, the other one of said cap and said drawer having a recess formed therein, when said cap closes said opening, said roller entering said recess to eliminate said gap, and when said cap slides relative to said drawer to open said opening, said roller sliding out from said recess to form said gap.

9. The drawer assembly according to claim 8, wherein said drawer has a top wall, said top wall of said drawer along a direction of movement of said roller has a limiting portion, said limiting portion is adapted to restrict movement of said roller in an axial direction of said limiting portion.

10. A refrigerator, comprising:

a storage compartment; and a drawer assembly according to claim 1, said drawer assembly disposed in said storage compartment, and being capable of being pulled out relative to said storage compartment.

* * * * *